US006102087A

United States Patent [19]

Roberts, Jr.

[11] Patent Number: 6,102,087

[45] Date of Patent: Aug. 15, 2000

[54] MULTI-FUEL BIB II

[76] Inventor: John Harold Roberts, Jr., 138 Johnstone La., Georgetown, S.C. 29440

[21] Appl. No.: 09/287,030

[22] Filed: Apr. 6, 1999

[51] Int. Cl.[7] ..... B65B 1/04

[52] U.S. Cl. ..... 141/86; 141/311 A

[58] Field of Search ..... 141/86, 87, 311 A; 220/573; 114/211, 343

[56] References Cited

U.S. PATENT DOCUMENTS 5,715,876 2/1998 Burt ..... 141/86

5,875,825 3/1999 Roberts, Jr. ..... 141/86

*Primary Examiner*—Steven O. Douglas

[57] ABSTRACT

A portable device for the retention of multi-fuel tanks on board marine vessels during the refueling process. The receiving receptacle will fit around the air vent on said tanks. Thus catching discharged fuels in its basin; from there it will pass into its own holding tank for later removal. It will cling to the side of vessel's hull with the aid of rope, counter weights and leverage levers.

1 Claim, 2 Drawing Sheets

MULTI-FUEL BIB II

BACKGROUND OF THE INVENTION

For retention of air vented fuel or gas, which is excelled during the refueling process of fixed fuel or gas tanks in a pleasure or commercial vessel. Most all fuel tanks are vented over the side of the vessel; hence when the tank is near fill, it starts to expel fuel or gas over the side of the boat into the water. It is a hazard to the environment, also a danger to human life and property. The U.S. Coast Guard has seen fit to impose large fines to deter this from happening. But there are still large amounts of fuel being spilled into our waterways, lakes and oceans from the same process of filing tanks every day. Much of this same fuel or gas can be seen on our waters as its film spreads and its rainbow effects can be seen and smelled from some distance away. People who go to sea want to be assured their fuel tanks are fill, so when the fuel comes to the top of their tanks, and spills fuel out of the fuel air vent, they will repeat the process, spilling more fuel into the water. Seldom will this fuel be retrieved with sorbent pads without an official nearby. Nor will the person turn himself in or the fuel attendant turn his customer into the proper officials. At this point the government may have it cleaned at the tax payer's expense.

Prior art to address this problem has been submitted by William D. Burt. This device attaches to the side of a vessel with a suction cup around a type of fuel air vent exhaust. Not all fuel air vent exhausts are fashioned in this manner. Some blow straight out of the side a vessel. In some cases, there are multiple fuel air vent exhausts side by side. While still other vents are not accessible by hand while on the vessel or on the dock.

There is also prior art submitted by Manin R. Petersen. Here again, the unit must be applied and removed by physical contact. When this unit is placed on the side of the vessel and left there, there will be a problem of a protruding object off the vertical plane when a vessel comes along side a fixed dock with pylons. The docking process could rip these units from the side of the vessel and cause property dames and/or fuel contamination to the area in question.

These applications are designed for fuel air vents within one's own reach and fail to take in to consideration the full scope of pre-existing placements of fuel air vents on board vessels to date. These fuel air vents are located on many different areas of the vertical plane. Their placement is dictated by design and maximum efficiency to suck in and blow out air for proper propulsion and refueling.

BRIEF SUMMARY OF THE INVENTION

The Multi-fuel Marine Bib is a device which will be temporarily mounted over the fuel tanks air venting system, which expels fuel during the refueling of Marine vessels.

The advantage and object of the bib is to capture and to contain fuels that discharge while refueling. The receiving receptacle will surround the fuel tank's air vents exhaust and capture fuel as it is expelled. This will be performed on a vertical plane by manipulating the geodesic receptacle via lengths of rope to achieve the desired positioning over air vents for maximum effect of accumulation of fuel products induced during the re-fueling of many marine vessels. The collection of these fuel products will greatly reduce the amount of fuel pollutants being spilled into our waterways due to a lack of a method of collection of fuel emitting from inaccessible air vents that a person cannot reach.

DETAILED DESCRIPTION OF THE DRAWINGS

Figure 1:
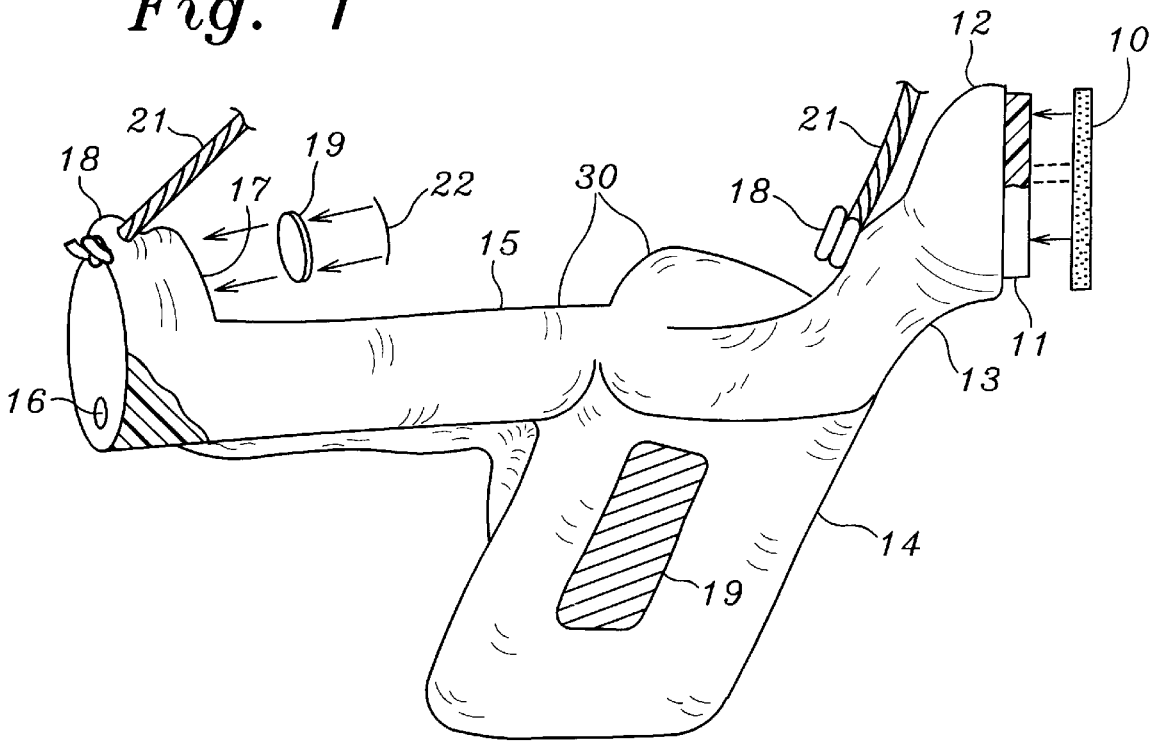
FIG. 1 is a perspective view of the multi-fuel marine bib II left or right side.
Figure 2:
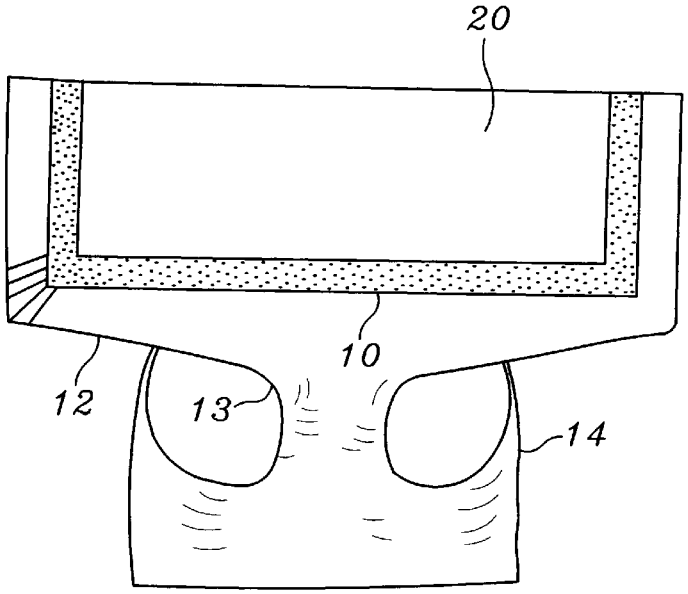
FIG. 2 is a head on of the multi-fuel marine bib II.

FIG. 1, the collection bib II device is designated by a general reference number 30. It will collect excess waste at a fuel tank's air vents. In FIG. 1, a gasket with fluid tight qualities 10, will be affixed to the lip 11.

FIG. 1, The lip 11, catch basin 12, down spout 13, holding tank 14, leverage arm 15, drain plug 16, accessory attachment base 17, cleat 18 and mouth opening 20, are all a part of one congeries unit. This shall be achieved via a two part mold and rotational molding with polypropylene material.

FIG. 1, the lip 11, will be formed to the catch basin 12, which will be formed to the downspout 13, which will be formed to the holding tank 14, which will be formed to the leverage arm 15, which will be formed to the accessory attachment base 17, which will be formed to the cleat 18, there will also be a cleat 18 formed to the back of the downspout 13.

FIG. 1, the cleat 18, will be for the purpose of tying off a rope 21, for tie manipulation of tie collection bib II 30, into place over fuel tank air vents on a vertical plane, at this time the rope 21, which is attached to the cleat 18, which is formed to the accessory attachment base 17, will be pulled up and in turn pull the collection bib II 30, on to the side of the vertical plane where the gasket 10, will bear the load of the collection bib II 30, the load of the collection bib II 30, will be increased via weights 19, which are attached to the side of the oblique holding tank 14, with adhesive, this will apply more pressure to the vertical plane and due to placement, assist in stabilizing the collection bib II, 30. The convexed mirror 22, may be attached to the weight 19, on the accessory attachment base 17, this will assist in the visual location of a fuel tanks air vent on the vertical plane of a vessel.

Figure 3:
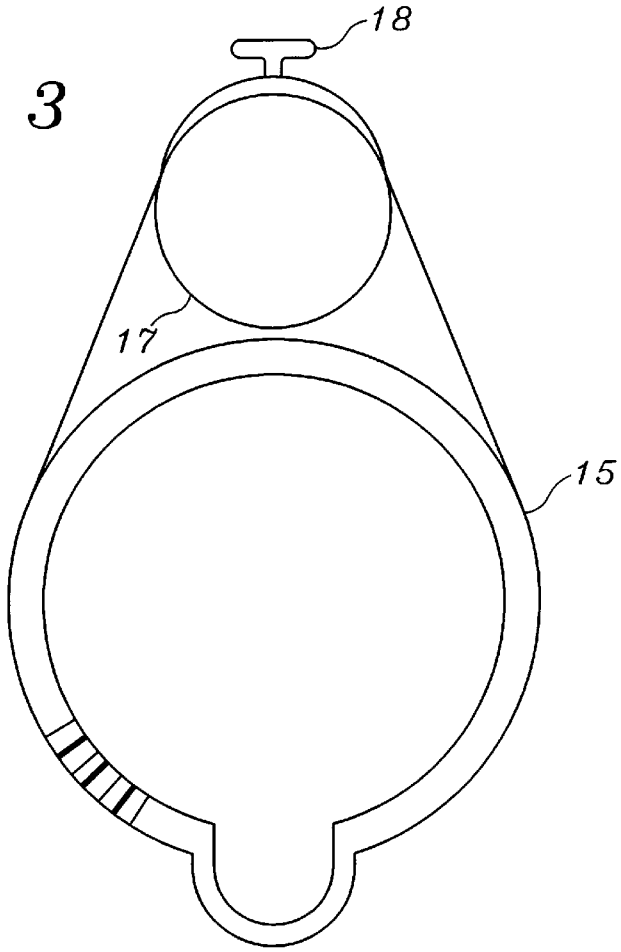
FIG. 3 is a head on view of the attachment area and a cut away of the leverage arm.

FIG. 3 is a cut away of the hollow leverage arm 15, which is cylindrical in shape and serves as a multi-tasking segment of the collection bib II, 30.

FIG. 3 the leverage arm 15, length will dictate its forward horizontal reach and imply leverage to the gasket 10.

FIG. 3 the leverage arm 15 hollow qualities will increase the quantity of material containment capabilities.

FIG. 3, the leverage arm 15, will also act as a spout for emptying the excess material captured by the collection bib II 30.

Figure 4:
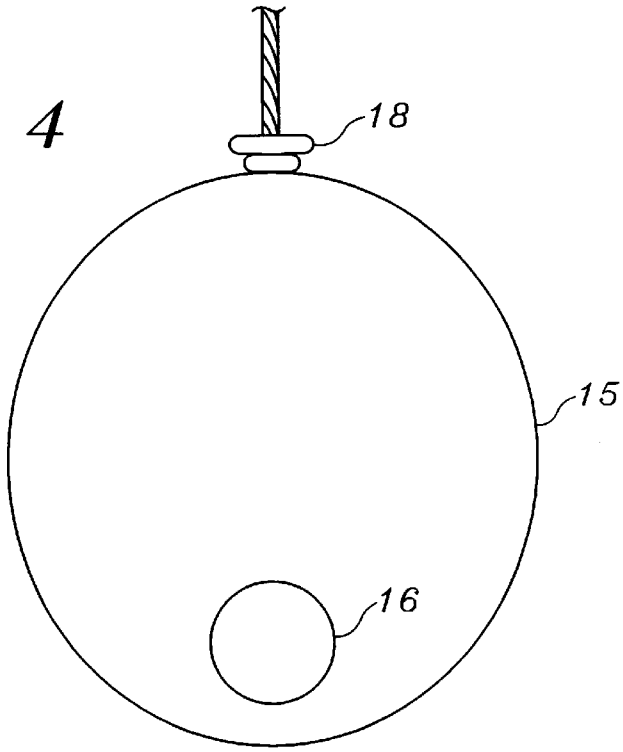
FIG. 4 is a rear view of leverage arm and drain plug.

FIG. 4, the back of the leverage arm 15 is where the drain port will be. The terms and expressions employed herein are terms of description and not of limitation. It is recognized that various modifications are possible within the scope of the invention claimed.

| OBJECTS OF THE INVENTION |
|---|
| 10. Gasket |
| 11. Lip |
| 12. Catch basin |
| 13. Down spout |
| 14. Holding tank |
| 15. Leverage arm |
| 16. Drain plug |

-continued

| OBJECTS OF THE INVENTION |
|---|
| 17. Accessory attachment base |
| 18. Cleat |
| 19. Weight |
| 20. Mouth opening |
| 21. Rope |
| 22. Convexed mirror |
| 30 Collection Bib II (the unit as a whole) |

I claim:

1. A fuel spillage control device comprising:

an oblong circular-shaped basin, a down spout projecting from a center portion of the basin and leading into a top junction between a holding tank and a leverage arm, and two lengths of rope attached to said leverage arm and said down spout to accommodate hoisting and attaching the device to a fuel vessel.

* * * * *